US008875679B2

(12) United States Patent
Yamazaki et al.

(10) Patent No.: US 8,875,679 B2
(45) Date of Patent: Nov. 4, 2014

(54) APPARATUS FOR ADJUSTING FUEL AMOUNT OF DIESEL ENGINE

(75) Inventors: Takahiro Yamazaki, Sakai (JP); Hiroki Kuwayama, Sakai (JP); Hozumi Ishida, Sakai (JP); Yutaka Ishigaki, Sakai (JP); Tadasi Nakano, Sakai (JP); Satoshi Fujii, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 439 days.

(21) Appl. No.: 13/412,145

(22) Filed: Mar. 5, 2012

(65) Prior Publication Data

US 2012/0160215 A1 Jun. 28, 2012

(30) Foreign Application Priority Data

Sep. 27, 2010 (JP) ..... 2010-214814

(51) Int. Cl.
*F02D 31/00* (2006.01)
*F02D 1/10* (2006.01)
*F02D 7/00* (2006.01)

(52) U.S. Cl.
CPC . *F02D 7/007* (2013.01); *F02D 1/10* (2013.01)
USPC ..... 123/364; 123/372

(58) Field of Classification Search
USPC ..... 123/364–367, 372, 373, 379, 388, 390, 123/446, 449, 198 D, 198 DB
See application file for complete search history.

(56) References Cited

U.S. PATENT DOCUMENTS 4,204,510 A * 5/1980 Ritter et al. ..... 123/179.16
4,690,115 A * 9/1987 Conlogue et al. ..... 123/366
4,920,938 A * 5/1990 Schwarz et al. ..... 123/373
5,063,900 A * 11/1991 Augustin ..... 123/373
5,148,789 A * 9/1992 Shiraishi et al. ..... 123/367
5,255,652 A * 10/1993 Boehm et al. ..... 123/366
5,275,140 A * 1/1994 Knoedl et al. ..... 123/364

FOREIGN PATENT DOCUMENTS

JP 06-001745 U 1/1994
JP 06-030541 U 4/1994
JP 11-062628 A 3/1999
JP 2003-027967 A 1/2003
JP 2010-071089 A 4/2010

OTHER PUBLICATIONS

Office Action issued Jan. 22, 2013 in JP Application No. 2010-214814.

* cited by examiner

*Primary Examiner* — John Kwon
*Assistant Examiner* — Johnny H Hoang
(74) *Attorney, Agent, or Firm* — Panitch Schwarze Belisario & Nadel LLP

(57) ABSTRACT

An apparatus for adjusting the fuel amount of a diesel engine is capable of preventing a decrease in the accuracy of the adjustment of the fuel amount. An engine stop operation input portion 12 is installed in the slider 5 and an engine stop operation output portion 13 is opposite to the engine stop operation input portion 12. When an engine stop operation is performed, engine stop operation force 14 is inputted from the engine stop operation output portion 13 to the engine stop operation input portion 12 and the slider 5 slides in the direction of the decrease in the fuel amount with the governor lever 1 remained intact so that the engine is stopped. A virtual line 16 is assumed to pass through a central portion of the biasing spring 9 when seen from a direction parallel to the adjustment amount rack pin 8.

6 Claims, 4 Drawing Sheets

INCREASE
DECREASE
INCREASE
DECREASE 1
2
3
4
5
9
13
17
18
19
20
25
30
31
32
32a
33
33a
34
35
37
38
39
46
47
48
49
50
(12)
B 37
43
38
39
1
33
32
34
35
36
33a
3
46

39
40
42
45
41

APPARATUS FOR ADJUSTING FUEL AMOUNT OF DIESEL ENGINE

BACKGROUND OF THE INVENTION

The present invention relates generally to an apparatus for adjusting the fuel amount of a diesel engine and, more particularly, to an apparatus for adjusting the fuel amount of a diesel engine which is capable of preventing a decrease in the accuracy of the adjustment of the fuel amount.

Conventionally, there is an apparatus for adjusting the fuel amount of a diesel engine in which the base end portion of the governor lever of a mechanical governor is pivoted on a governor lever shaft. A slider is slidingly mounted on the swing end portion of the governor lever in the direction of an increase and decrease in the fuel amount. The adjustment amount rack pin of a fuel injection pump is engaged in the rack pin engagement portion of the slider so that the slider is biased by a biasing spring in the direction of an increase in the fuel amount. A stopper is installed in the governor lever and a locking portion facing the stopper is installed in the slider so that the locking portion is supported by the stopper and thus the movement of the slider in the direction of an increase in the fuel amount is stopped. An engine stop operation input portion is installed in the slider and an engine stop operation output portion is opposite to the engine stop operation input portion so that, at the time of an engine stop operation, engine stop operation force is inputted from the engine stop operation output portion to the engine stop operation input portion, the slider slides in the direction of a decrease in the fuel amount with the governor lever remained intact, and thus the engine is stopped (see FIG. 1 of Japanese Patent Publication No. 2003-27967).

In accordance with this kind of an apparatus for adjusting the fuel amount, there is an advantage in that the engine stop operation force can be reduced because the engine can be stopped by sliding the slider in the direction of a decrease in the fuel amount without the influence of the governor spring force applied to the governor lever.

In the prior art, however, if a virtual line is assumed to pass through the central portion of the biasing spring when seen from a direction parallel to the adjustment amount rack pin and a shaft-distant side spaced apart from the governor lever shaft and a shaft-proximal side proximal to the governor lever shaft are divided on the basis of the virtual line, the stopper is disposed only in the shaft-proximal side. Thus, there is a problem with the prior art.

There is a possibility that the accuracy of the adjustment of the fuel amount may be deteriorated.

If a virtual line is assumed to pass through the central portion of the biasing spring (i.e., energizing spring) when seen from a direction parallel to the adjustment amount rack pin and a shaft-distant side spaced apart from the governor lever shaft and a shaft-proximal side proximal to the governor lever shaft are divided on the basis of the virtual line, the slider is inclined on the basis of the stopper by means of biasing force of the biasing spring because the stopper is disposed only in the shaft-proximal side, and thus the position of the adjustment amount rack pin is dislocated. Accordingly, there is a possibility that the accuracy of the adjustment of a fuel amount may be deteriorated.

BRIEF SUMMARY OF THE INVENTION

An objective of the present invention is to provide an apparatus for adjusting the fuel amount of a diesel engine which is capable of preventing a decrease in the accuracy of the adjustment of a fuel amount.

The characteristic of a preferred embodiment of the present invention are as follows.

In an apparatus for adjusting the fuel amount of a diesel engine in which as illustrated in FIGS. 1 and 2(A), the base end portion 2 of the governor lever 1 of a mechanical governor is pivoted on a governor lever shaft 3. A slider 5 is slidingly mounted on the swing end portion 4 of the governor lever 1 in the direction of an increase and decrease in the fuel amount. The adjustment amount rack pin 8 of a fuel injection pump 7 is engaged in the rack pin engagement portion 6 of the slider 5 so that the slider 5 is biased by a biasing spring 9 in the direction of the increase in the fuel amount. As illustrated in FIG. 2(A), stoppers 10 are installed in the governor lever 1 and locking portions 11 facing the stoppers 10 are installed in the slider 5 so that the locking portions 11 are supported by the stoppers 10 and thus the movement of the slider 5 in the direction of the increase in the fuel amount is stopped. An engine stop operation input portion 12 is installed in the slider 5 and an engine stop operation output portion 13 is opposite to the engine stop operation input portion 12. As illustrated in FIG. 2(B), when an engine stop operation is performed, engine stop operation force 14 is inputted from the engine stop operation output portion 13 to the engine stop operation input portion 12 and the slider 5 slides in the direction of the decrease in the fuel amount with the governor lever 1 remained intact so that the engine is stopped. Ss illustrated in FIG. 2(A), a virtual line 16 is assumed to pass through the central portion of the biasing spring 9 when seen from a direction parallel to the adjustment amount rack pin 8, a shaft-distant side 30 spaced apart from the governor lever shaft 3 and a shaft-proximal side 31 proximal to the governor lever shaft 3 are divided on the basis of the virtual line 16, and the stoppers 10 are disposed in the shaft-distant side 30 and the shaft-proximal side 31, respectively.

A preferred embodiment of the present invention exhibits the following advantage.

An effect of a preferred embodiment of the present invention is a decrease in the accuracy of the adjustment of the fuel amount can be prevented.

As illustrated in FIG. 2(A), the virtual line 16 is assumed to pass through the central portion of the biasing spring 9 when seen from the direction parallel to the adjustment amount rack pin 8, the shaft-distant side 30 spaced apart from the governor lever shaft 3 and the shaft-proximal side 31 proximal to the governor lever shaft 3 are divided on the basis of the virtual line 16, and the stoppers 10 are disposed in the shaft-distant side 30 and the shaft-proximal side 31, respectively. Accordingly, the slider 5 is supported by the stoppers 10 on both sides of the virtual line 16, and thus the slider 5 is not inclined on the basis of the stoppers 10 owing to biasing force 26 of the biasing spring 9. As a result, a decrease in the accuracy of an adjustment amount resulting from the dislocation of the position of the adjustment amount rack pin 8 can be prevented.

Another effect of a preferred embodiment of the present invention is the locking portion of the biasing spring and the stop operation input portion can be easily formed.

As illustrated in FIGS. 2(A) and 3(A), the slider 5 is formed by sheet metal, a lead-out piece 17 led out from the slider 5 to the shaft-distant side 30 is bent toward the shaft-proximal side 31 by means of a bending process while being spaced apart from the governor lever 1, the locking hole 19 of the biasing spring 9 is formed in the curved end portion 18 of the lead-out piece 17, and the curved portion 20 of the lead-out piece 17 is used as the engine stop operation input portion 12. Accordingly, the locking portion of the biasing spring 9 and the engine stop operation input portion 12 can be easily formed.

An effect of a preferred embodiment of the present invention is that a decrease in the accuracy of the adjustment of the fuel amount can be prevented.

As illustrated in FIGS. 2(A), 2(C), and 2(D), the governor lever 1 is formed by sheet metal, and the stopper 10 is protruded from a surface of the governor lever 1 by using a half-piercing process. Accordingly, positioning accuracy of the slider 5 is high as compared to the case where the stoppers 10 are formed using a bending process, and thus a decrease in the accuracy of the adjustment of the fuel amount resulting from the dislocation of the position of the adjustment amount rack pin 8 can be prevented.

As illustrated in FIG. 2(A), the stopper 10 is formed to have a longitudinal shape conforming to the locking portion 11 of the slider 5. Accordingly, the posture of the slider 5 supported by the stoppers 10 is stabilized, and thus a decrease in the accuracy of the adjustment of the fuel amount resulting from the dislocation of the position of the adjustment amount rack pin 8 can be prevented.

An effect of a preferred embodiment of the present invention is the assembly of the slider into the governor lever is facilitated.

As illustrated in FIG. 2(D), a slide guidance projection 22 on one side includes a pin 25 configured to have a base end portion fixed to the governor lever 1 and a large diameter portion 29 formed in the leading end portion of the pin 25, and the pin 25 penetrates a slide guidance long hole 24 so that the large diameter portion 29 prevents the slider 5 from being taken off from the pin 25. A slide guidance projection 23 on the other side is protruded from a surface of the governor lever 1 by a half-piercing process. Accordingly, when the slider 5 is assembled into the governor lever 1, the pin 25 of the slide guidance projection 22 on one side has only to penetrate the slide guidance long hole 24 and thus the base end portion of the pin 25 has only to be fixed to the governor lever 1, and the slide guidance projection 23 on the other side needs not to be fixed. Accordingly, the assembly of the slider 5 into the governor lever 1 is facilitated as compared with the case in which both the slide guidance projections 22 and 23 on both sides are fixed to the governor lever 1.

An effect of a preferred embodiment of the present invention is that a problem that the slider is locked while returning to the stopper can be avoided.

As illustrated in FIG. 2(B), when the fuel amount increase face 27 of the slider 5 and the fuel amount decrease face 28 of the governor lever 1 pass each other, the directions of the fuel amount increase face 27 of the slider 5 and the fuel amount decrease face 28 of the governor lever 1 are set so that the fuel amount increase face 27 and the fuel amount decrease face 28 are widened toward the shaft-distant side 30. Therefore, even when the fuel amount increase face 27 of the slider 5 is about to rise on the fuel amount decrease face 28 of the governor lever 1, the rise of the fuel amount increase face 27 is avoided because the edge of the fuel amount increase face 27 of the slider 5 slides along the edge of the fuel amount decrease face 28 of the governor lever 1. Accordingly, a problem that the slider 5 is locked while returning to the stoppers 10 owing to the rise can be avoided.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Certain terminology is used in the following description for convenience only and is not limiting. Unless specifically set forth herein, the terms "a," "an" and "the" are not limited to one element, but instead should be read as meaning "at least one." The terminology includes the words noted above, derivatives thereof and words of similar import.

FIGS. 1-4 are diagrams illustrating an apparatus for adjusting the fuel amount of a diesel engine according to a preferred embodiment of the present invention. In the presently preferred embodiment, an apparatus for adjusting the fuel amount of a vertical (upright type) diesel engine is described.

Figure 1:
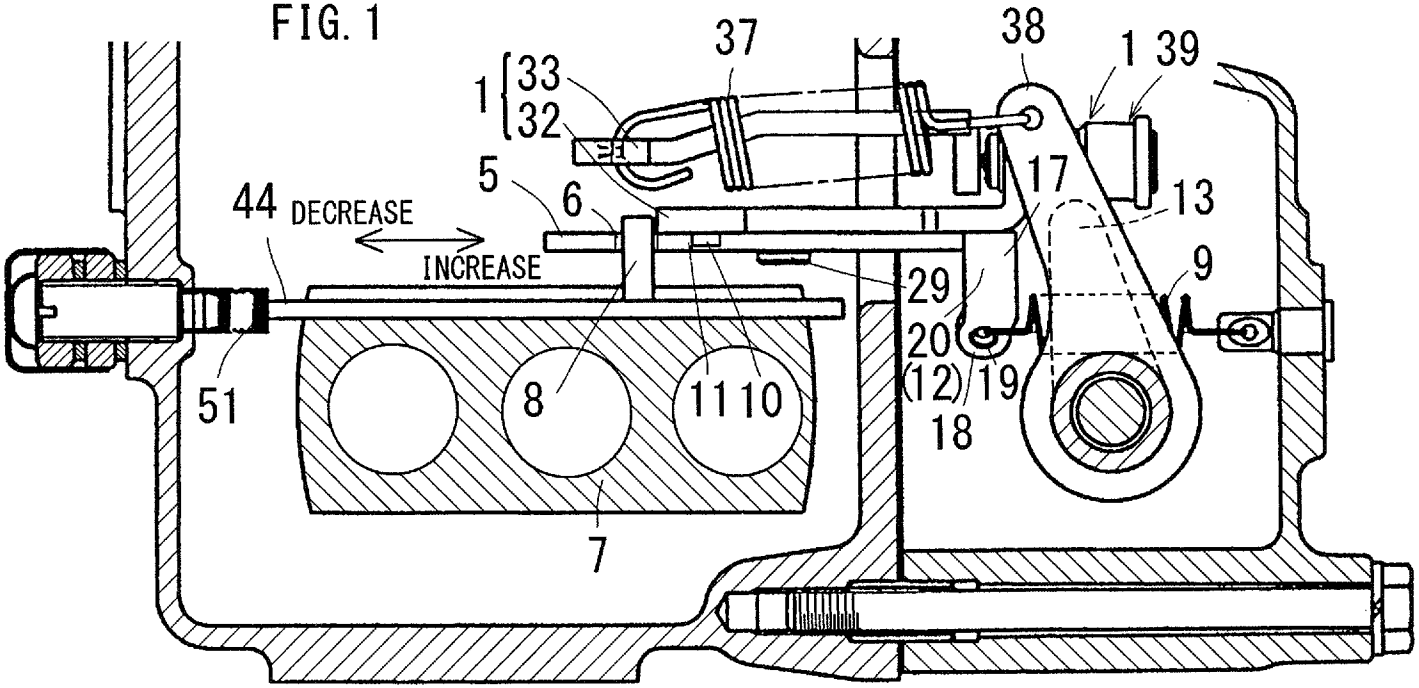
FIG. 1 is a lateral plan view of an apparatus for adjusting the fuel amount of a diesel engine according to a preferred embodiment of the present invention.
Figures 2A, 2B, 2C, 2D:
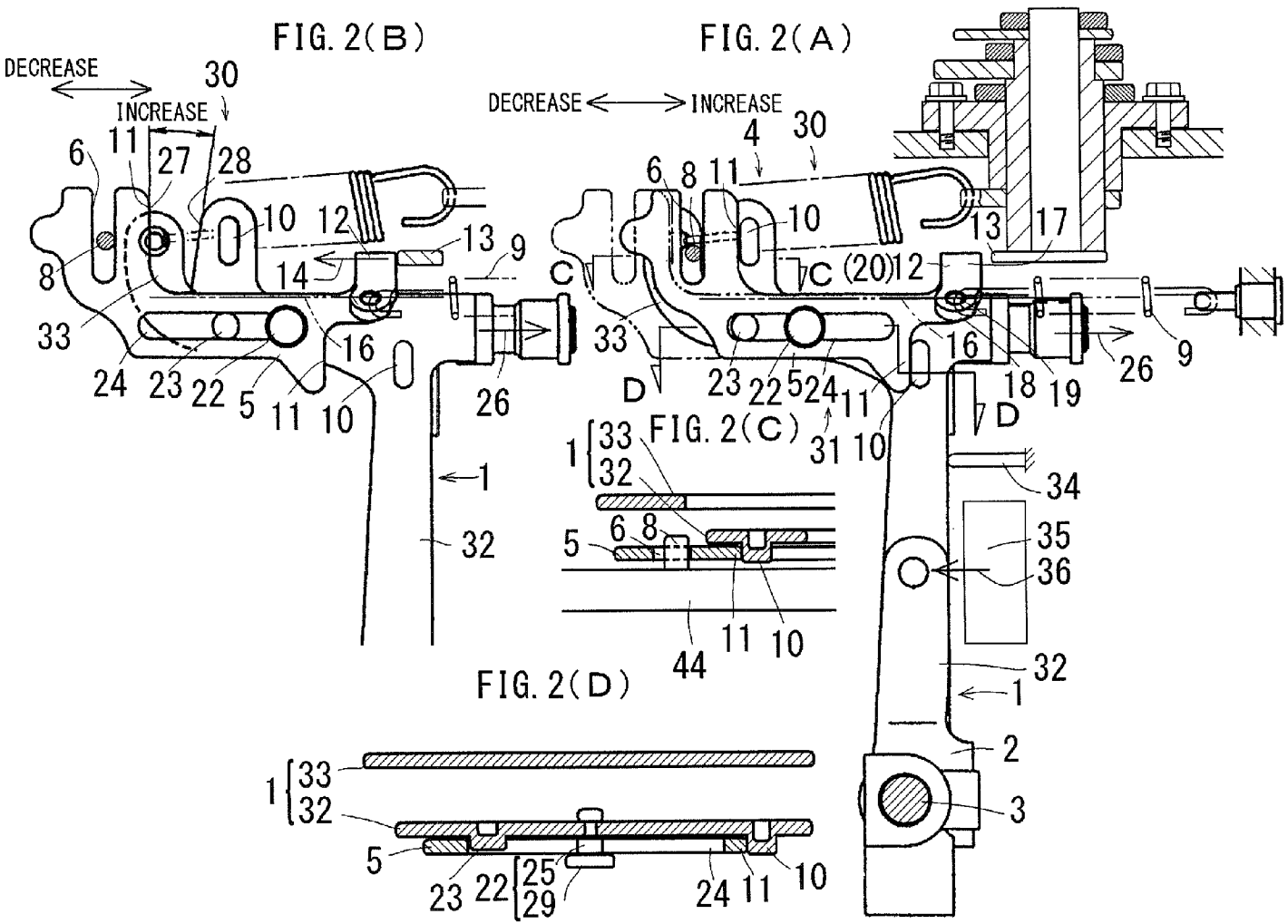
FIG. 2(A) is a lateral view of the governor lever and its peripheral parts of the apparatus shown in FIG. 1.
FIG. 2(B) is an explanatory diagram at the time of an engine stop operation.
FIG. 2(C) is a cross-sectional view taken along line C-C in FIG. 2(A)
FIG. 2(D) is a cross-sectional view taken along line D-D in FIG. 2(A)

As illustrated in FIGS. 1 and 2(A), a base end portion 2 of a governor lever 1 of a mechanical governor is pivoted on a governor lever shaft 3. A slider 5 is slidingly mounted on the swing end portion 4 of the governor lever 1 in the direction of an increase and decrease in the fuel amount. An adjustment amount rack pin 8 of a fuel injection pump 7 is engaged in a rack pin engagement portion 6 of the slider 5 so that the slider 5 is biased by a biasing spring 9 in the direction of the increase in the fuel amount.

As illustrated in FIG. 2(A), stoppers 10 are installed in the governor lever 1 and locking portions 11 facing the stoppers 10 are installed in the slider 5 so that the locking portions 11 are supported by the stoppers 10 and thus the movement of the slider 5 in the direction of the increase in the fuel amount is stopped.

An engine stop operation input portion 12 is installed in the slider 5, and an engine stop operation output portion 13 is opposite to the engine stop operation input portion 12.

As illustrated in FIG. 2(B), when an engine stop operation is performed, engine stop operation force 14 is inputted from the engine stop operation output portion 13 to the engine stop operation input portion 12 so that the slider 5 slides in the direction of the decrease in the fuel amount with the governor lever 1 remained intact and thus the engine is stopped.

As shown in FIG. 3, the governor lever 1 of the mechanical governor includes a governor force input lever 32 and a spring force input lever 33, and the base end portions 32*a* and 33*a* of the governor force input lever 32 and the spring force input lever 33, respectively, are pivoted on the governor lever shaft 3. A fuel restriction tool 34 faces the spring force input lever 33 from its fuel amount increase swing side.

The governor force input lever 32 and the spring force input lever 33 are formed by sheet metal.

As shown in FIG. 1, a fuel amount adjustment rack 44 is biased to the fuel amount increase side by means of a high idle spring 51, so that the adjustment amount rack pin 8 is not swung within the rack pin engagement portion 6.

Figures 4A, 4B:
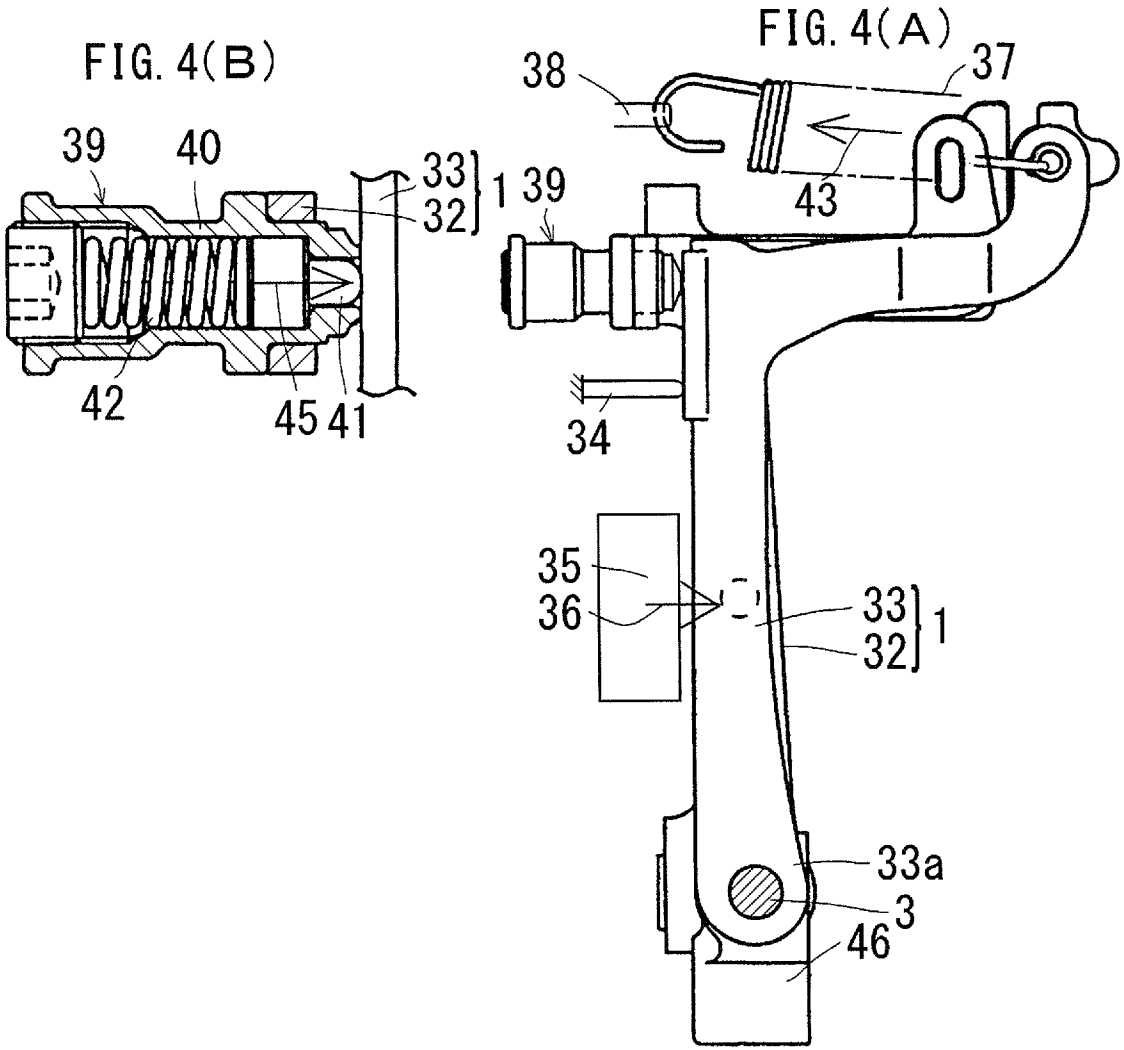
FIG. 4(A) is a lateral view of the governor lever of the apparatus shown in FIG. 1, which is seen from an opposite side to FIG. 2(A)
FIG. 4(B) is a longitudinal lateral view of a torque rise apparatus.

As shown in FIG. 4(A), the governor force input lever 32 is operated in conjunction with governor force generation means 35, so that governor force 36 is inputted from the governor force generation means 35 to the governor force input lever 32. The spring force input lever 33 is coupled to a speed control lever 38 through a governor spring 37 so that the spring force input lever 33 is operated in conjunction with the speed control lever 38. A torque rise device 39 is mounted on the governor force input lever 32, and the torque rise device 39 is brought in contact with the spring force input lever 33.

As shown in FIG. 4(B), the torque rise device 39 is configured to accommodate a torque rise pin 41 and a torque rise spring 42 within a torque rise holder 40 and to bias the torque rise pin 41 by the torque rise spring 42 in a forward pushing direction. The leading end portion of the torque rise pin 41 is brought in contact with the spring force input lever 33.

In a high-speed operation in which the governor lever 38 is set to the high-speed side, the leading end portion of the torque rise pin 41 is pushed into the torque rise holder 40 by means of the governor force 36 and governor spring force 43, and the governor force input lever 32 and the spring force input lever 33 are integrally swung owing to imbalance between the governor force 36 and the governor spring force 43 with the leading end portion of the torque rise holder 40 being brought in contact with the spring force input lever 33. Accordingly, the fuel amount adjustment rack 44 of the fuel injection pump 7 is adjusted and moved.

When the engine is overloaded, the governor force 36 becomes weak by a reduction in the rotation of the engine, the spring force input lever 33 is received by the fuel restriction tool 34, only the governor force input lever 32 is swung by imbalance between the governor force 36 and the torque rise spring force 45, and the fuel amount adjustment rack 44 of the fuel injection pump 7 is adjusted and moved so that the engine stop is suppressed by a torque rise.

The torque rise holder 40 is mounted on the governor force input lever 32 by means of screw fitting. If a torque rise characteristic is changed, the existing torque rise holder 40 may be replaced with another torque rise holder 40 that accommodates the torque rise pin 41 having a different allowance or the torque rise spring 42 having a different spring characteristic.

Figures 3A, 3B:
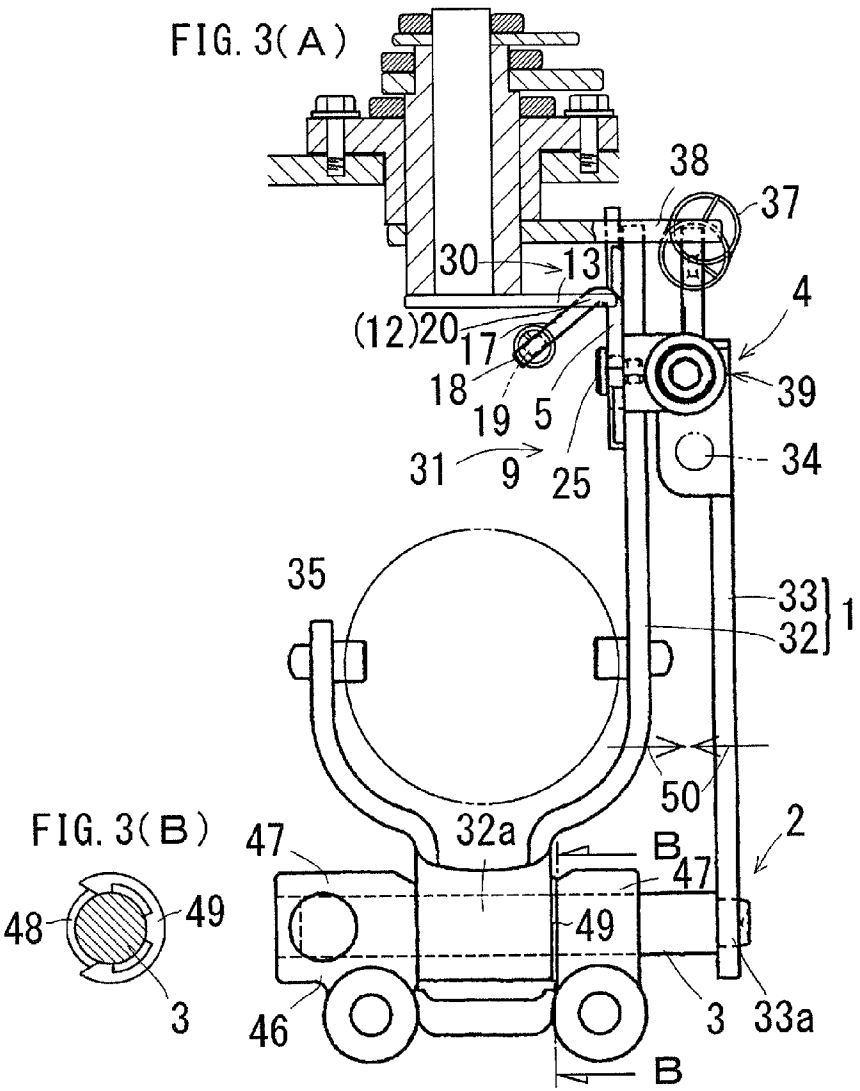
FIG. 3(A) is a front view of the governor lever and its peripheral parts of the apparatus shown in FIG. 1.
FIG. 3(B) is a cross-sectional view taken along line B-B in FIG. 3(A)

As shown in FIG. 3(A), the governor lever shaft 3 is supported by the wall of the engine body through a bracket 46. A pair of bosses 47 are disposed in the bracket 46, the governor lever shaft 3 is loosely fit into the pair of bosses 47, the base end portion 32*a* of the governor force input lever 32 is disposed between the pair of bosses 47, and the base end portion 32*a* of the governor force input lever 32 is loosely fit into the governor lever shaft 3. A ring groove 48 is formed in the outer periphery of the governor lever shaft 3 between the pair of bosses 47, a snap ring 49 is mounted on the ring groove 48, and the snap ring 49 is inserted between the boss 47 on one side and the base end portion 32*a* of the governor force input lever 32 so that the governor lever shaft 3 is not taken off. The snap ring 49 is an E-shaped snap ring. The base end portion 33*a* of the spring force input lever 33 is fixed to the governor lever shaft 3 outside the boss 47.

As shown in FIG. 3(A), if force 50 is applied to the governor force input lever 32 and the spring force input lever 33 in a mutual proximity direction by means of vibration or the governor spring force 43, the pieces of force 50 and 50 function as the pressure-contact force of the snap ring 49 and the base end portion 32*a* of the governor force input lever 32. However, while the governor force input lever 32 and the spring force input lever 33 are integrally swung, the pressure-contact force does not act as resistance to the swing, and thus the governor lever 1 is smoothly swung.

As shown in FIG. 2(A), a virtual line 16 is assumed to pass through the central portion of the biasing spring 9 when seen from a direction parallel to the adjustment amount rack pin 8, a shaft-distant side 30 spaced apart from the governor lever shaft 3 and a shaft-proximal side 31 proximal to the governor lever shaft 3 are divided on the basis of the virtual line 16, and the stoppers 10 and 10 are disposed in the shaft-distant side 30 and the shaft-proximal side 31, respectively.

The stoppers 10 and 10 are formed in the governor force input lever 32 on which the slider 5 is mounted.

As shown in FIGS. 2(A) and 3(A), the slider 5 is formed by sheet metal, a lead-out piece 17 led out from the slider 5 to the shaft-distant side 30 is bent toward the shaft-proximal side 31 by means of a bending process while being spaced apart from the governor lever 1, the locking hole 19 of the biasing spring 9 is formed in the curved end portion 18 of the lead-out piece 17, and the curved portion 20 of the lead-out piece 17 is used as the engine stop operation input portion 12.

As shown in FIGS. 2(A), 2(C), and 2(D), the governor lever 1 is formed by sheet metal, and the stoppers 10 are protruded from a surface of the governor lever 1 by means of a half-piercing process.

As shown in FIG. 2(A), the stopper 10 is formed to have a longitudinal shape conforming to the locking portion 11 of the slider 5.

As shown in FIG. 2(D), a pair of slide guidance projections 22 and 23 are formed in the governor lever 1, a slide guidance long hole 24 is formed in the slider 5, and the pair of slider guidance projections 22 and 23 is inserted into the slide guidance long hole 24 as follows.

The slide guidance projection 22 on one side includes a pin 25 configured to have a base end portion fixed to the governor lever 1 and a large diameter portion 29 formed in a leading end portion of the pin 25, and the pin 25 penetrates a slide guidance long hole 24 so that the large diameter portion 29 prevents the slider 5 from being taken off from the pin 25.

The slide guidance projection 23 on the other side is protruded from a surface of the governor lever 1 by a half-piercing process.

As shown in FIG. 2(B), the slider 5 returns to the fuel amount increase side by the biasing force 26 of the biasing spring 9 after the engine stop operation by the sliding of the slider 5 in the direction of the decrease in the fuel amount, and the fuel amount increase face 27 of the slider 5 and the fuel amount decrease face 28 of the governor lever 1 pass each other as follows.

The directions of the fuel amount increase face 27 of the slider 5 and the fuel amount decrease face 28 of the governor lever 1 are set so that the fuel amount increase face 27 and the fuel amount decrease face 28 are widened toward the shaft-distant side 30 when the fuel amount increase face 27 of the slider 5 and the fuel amount decrease face 28 of the governor lever 1 pass each other.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for adjusting the fuel amount of a diesel engine comprising:

a base end portion 2 of a governor lever 1 of a mechanical governor being pivoted on a governor lever shaft 3, a slider 5 being slidingly mounted on a swing end portion 4 of the governor lever 1 in a direction of an increase and decrease in a fuel amount, and an adjustment amount rack pin 8 of a fuel injection pump 7 being engaged in a rack pin engagement portion 6 of the slider 5 so that the slider 5 is biased by a biasing spring 9 in the direction of the increase in the fuel amount, stoppers 10 installed in the governor lever 1 and locking portions 11 facing the stoppers 10 installed in the slider 5 so that the locking portions 11 are supported by the stoppers 10 and thus a movement of the slider 5 in the direction of the increase in the fuel amount is stopped, and an engine stop operation input portion 12 installed in the slider 5 and an engine stop operation output portion 13 opposite to the engine stop operation input portion 12, when an engine stop operation is performed, an engine stop operation force 14 is inputted from the engine stop operation output portion 13 to the engine stop operation input portion 12 and the slider 5 slides in the direction of the decrease in the fuel amount with the governor lever 1 remained intact so that the engine is stopped, and wherein a virtual line 16 is assumed to pass through a central portion of the biasing spring 9 when seen from a direction parallel to the adjustment amount rack pin 8, a shaft-distant side 30 spaced apart from the governor lever shaft 3 and a shaft-proximal side 31 proximal to the governor lever shaft 3 being divided on the basis of the virtual line 16, and the stoppers 10 being disposed in the shaft-distant side 30 and the shaft-proximal side 31, respectively.

2. The apparatus according to claim 1, wherein the slider 5 is formed by sheet metal, a lead-out piece 17 led out from the slider 5 to the shaft-distant side 30 being bent toward the shaft-proximal side 31 by means of a bending process while being spaced apart from the governor lever 1, a locking hole 19 of the biasing spring 9 being formed in a curved end portion 18 of the lead-out piece 17, and a curved portion 20 of the lead-out piece 17 being used as the engine stop operation input portion 12.

3. The apparatus according to claim 1, wherein the governor lever 1 is formed by sheet metal, and the stoppers 10 are protruded from a surface of the governor lever 1 by a half-piercing process.

4. The apparatus according to claim 3, wherein the stopper 10 is formed to have a longitudinal shape conforming to the locking portion 11 of the slider 5.

5. The apparatus according to claim 1, wherein:

in forming a pair of slide guidance projections 22, 23 in the governor lever 1, forming a slide guidance long hole 24 in the slider 5, and inserting the pair of slider guidance projections 22, 23 into the slide guidance long hole 24, the slide guidance projection 22 on one side includes a pin 25 having a base end portion fixed to the governor lever 1 and a large diameter portion 29 formed in a leading end portion of the pin 25, and the pin 25 penetrates the slide guidance long hole 24 so that the large diameter portion 29 prevents the slider 5 from being taken off from the pin 25, and the slide guidance projection 23 on the other side is protruded from a surface of the governor lever 1 by a half-piercing process.

6. The apparatus according to claim 1, wherein:

when the slider 5 returns to a fuel amount increase side by a biasing force 26 of the biasing spring 9 after an engine stop operation by the sliding of the slider 5 in the direction of the decrease in the fuel amount and a fuel amount increase face 27 of the slider 5 and a fuel amount decrease face 28 of the governor lever 1 pass each other, directions of the fuel amount increase face 27 of the slider 5 and the fuel amount decrease face 28 of the governor lever 1 are set so that the fuel amount increase face 27 and the fuel amount decrease face 28 are widened toward the shaft-distant side 30 when the fuel amount increase face 27 of the slider 5 and the fuel amount decrease face 28 of the governor lever 1 pass each other.

* * * * *